US009403043B2

(12) United States Patent
Peters

(10) Patent No.: US 9,403,043 B2
(45) Date of Patent: Aug. 2, 2016

(54) AIR WARMING APPARATUS

(71) Applicant: David Peters, Troy, MI (US)

(72) Inventor: David Peters, Troy, MI (US)

( * ) Notice: Subject to any disclaimer, the term of this patent is extended or adjusted under 35 U.S.C. 154(b) by 410 days.

(21) Appl. No.: 13/969,632

(22) Filed: Aug. 19, 2013

(65) Prior Publication Data

US 2015/0047637 A1 Feb. 19, 2015

(51) Int. Cl.

| | |
|---|---|
| ***A62B 9/00*** | (2006.01) |
| ***A62B 9/04*** | (2006.01) |
| ***A62B 9/02*** | (2006.01) |
| ***A62B 7/12*** | (2006.01) |
| *A62B 17/00* | (2006.01) |

(52) U.S. Cl.

CPC . *A62B 9/003* (2013.01); *A62B 7/12* (2013.01); *A62B 17/005* (2013.01)

(58) Field of Classification Search

CPC ..... A62B 9/003; A62B 7/12; A62B 17/005

USPC ..... 128/204.17, 204.13, 201.13, 201.26, 128/205.12, 205.17, 201.29; 607/107, 104, 607/108; 126/204; 285/122.1, 120.1

See application file for complete search history.

(56) References Cited

U.S. PATENT DOCUMENTS

| | | | | |
|---|---|---|---|---|
| 3,707,966 A * | 1/1973 | Nebel | A61M 16/1075 | 128/204.13 |
| 4,355,636 A * | 10/1982 | Oetjen | A61M 16/16 | 128/204.13 |
| 5,662,161 A * | 9/1997 | Hughes | A62B 9/003 | 128/201.13 |
| 5,998,160 A * | 12/1999 | Berens | C12Q 1/24 | 435/30 |
| 2004/0033639 A1 * | 2/2004 | Chinn | B81B 3/0005 | 438/59 |

* cited by examiner

*Primary Examiner* — Tan-Uyen (Jackie) T Ho
*Assistant Examiner* — Mark Wardas
(74) *Attorney, Agent, or Firm* — Gulf Coast Intellectual Property Group

(57) ABSTRACT

An air warming apparatus operable to provide a user breathing air wherein the air is warmer than that of the user's environment. The air warming apparatus includes a filtered air intake operably coupled to an intake manifold. A lower air transport assembly circumferentially surrounds a user's torso and is adjacent thereto and provides the first phase of air warming for air flowing therethrough. A return manifold operably couples the lower air transport assembly and the upper air transport assembly and further contains a humidifier therein. The upper air transport assembly is surroundably mounted to the user and provides the second phase of air warming. An upper chamber of the intake manifold operably couples the upper air transport assembly and the breathing assembly. The breathing assembly includes a mouthpiece and a breathing valve that is operable to control the air flow through the air warming apparatus.

18 Claims, 4 Drawing Sheets

AIR WARMING APPARATUS

FIELD OF THE INVENTION

The present invention relates to an air warming apparatus, more specifically but not by way of limitation an air warming apparatus operable to increase the temperature of the air inhaled by a user when a user is disposed in an environment that is cooler than that of the average human body temperature.

BACKGROUND

Whether for work or for recreation, individuals routinely find themselves exposed to an environment having unfavorable conditions such as cold temperatures. Whether it is an athlete that is jogging or biking in forty-degree temperatures or a rescue or construction worker that must execute a particular task outdoors regardless of the conditions, people often find themselves disposed in uncomfortable temperatures. While individuals that find themselves outdoors in cold environments have numerous options for protective clothing such as but not limited to jackets and gloves, it is often overlooked to provide a more comfortable breathing experience.

Breathing of cold air during physical activity such as but not limited to running has been shown to increase the chance of exercise-induced bronchoconstriction. It is thought that cold temperatures of air cause slight and temporary narrowing of the airways of the individual engaged in physical activity. This temporary condition makes it more difficult to breath and is uncomfortable for the individual exposed to the colder temperatures. Furthermore, it is known that colder air has a typically lower humidity level, which is further believed to provoke exercise-induced bronchoconstriction.

While engaged in physical activity most people tend to breathe through their mouth instead of their nasal passage. Breathing air through the nose helps warm and moisturize the air prior to entering the lungs. As a user begins to breathe more heavily during physical activity the breathing switches to utilizing the mouth for inhalation. This results in drier and colder air being inhaled and thus increases the discomfort level for the individual.

Accordingly, there is a need for an air warming apparatus that can be worn by a user that provides warm air having a higher humidity level than the surrounding environment wherein the air warming apparatus facilitates the introduction of warm air to the user via a mouthpiece to accommodate the user during physical activity.

SUMMARY OF THE INVENTION

It is the object of the present invention to provide an air warming apparatus that facilitates the introduction of air into the respiratory system of a user that is warmer than that of its surroundings.

Another object of the present invention is to provide an air warming apparatus that facilitates the breathing of air warmer than that of the user's surrounding environment wherein the air inhaled by the user further has a higher humidity level than that of the air of the surrounding environment.

A further object of the present invention is to provide an air warming apparatus that is operable to provide air to a user having a higher temperature and humidity than that of the surrounding air that is substantially mounted to the user's torso.

Yet another object of the present invention is to provide an air warming apparatus that includes an intake manifold wherein the air entering the intake manifold initially passes through an air filter.

Still a further object of the present invention is to provide an air warming apparatus that is operable to provide air to a user having a higher temperature than that of the surrounding environment having a tube assembly that is surroundably mounted to the user.

An additional object of the present invention is to provide an air warming apparatus that is operable to provide warm and humidified air to a user having a air return manifold wherein the air return manifold further has a moisture adding device disposed therein.

Yet a further object of the present invention is to provide an air warming apparatus that is operable to provide air that is of a greater temperature and humidity than that of the user's surroundings that further includes an inhalation tube operably coupled to the tube assembly.

Another object of the present invention is to provide an air warming apparatus that is operable to provide warm air to a user that further includes a mouthpiece assembly that is operably coupled to the inhalation tube.

Still another object of the present invention is to provide an air warming apparatus that includes keepers and a belt so as to be easily secured to a user.

Yet an additional object of the present invention is to provide an air warming apparatus operable to provide air to a user that is warmer and more humid than the air surrounding a user that includes a valve within the mouthpiece assembly that functions to control the airflow within the air warming apparatus.

A further object of the present invention is to provide an air warming apparatus that is lightweight and easy to use.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
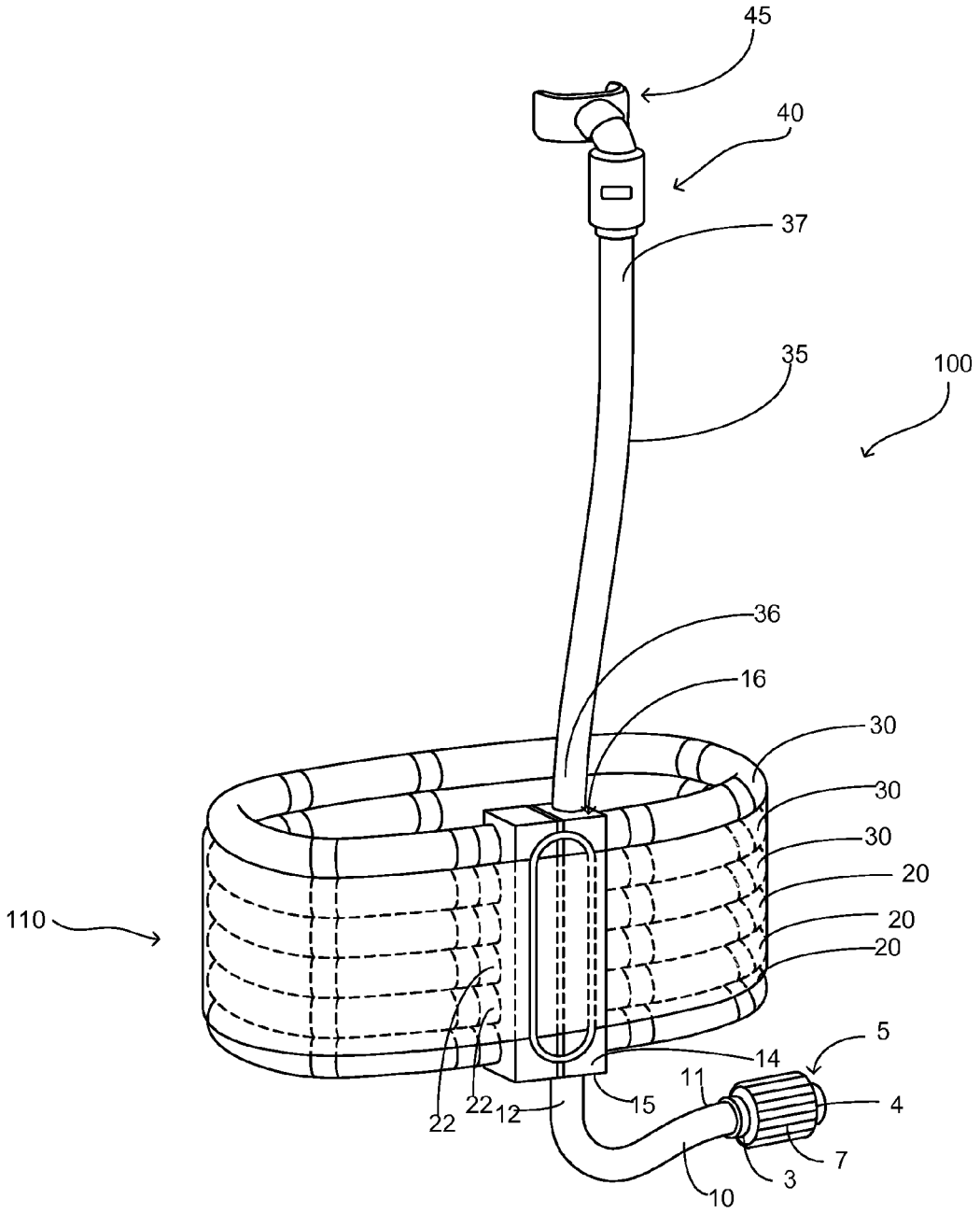
FIG. 1 is a perspective view of a preferred embodiment of the present invention.

Referring now to the drawings submitted herewith, wherein various elements depicted therein are not necessarily drawn to scale and wherein through the views and figures like elements are referenced with identical reference numerals, there is illustrated a air warming apparatus 100 constructed according to the principles of the present invention.

Referring in particular to FIG. 1, the air warming apparatus 100 further includes an air intake 5 having a filter 7 that is operably coupled to an intake tube 10. The intake tube 10 is operably coupled to the intake manifold 15. Operably coupled to the intake manifold 15 are a plurality of lower air transport members 20. The lower air transport members 20 operably coupled the intake manifold 15 and the return manifold 25. The return manifold 25 is adjacent to the intake manifold 15 when the air warming apparatus is being worn by a user. The intake manifold 15 and return manifold 25 are releasably secured utilizing suitable techniques. A plurality of upper air transport members 30 extend intermediate the return manifold 25 and the intake manifold 15. Extending upward from the upper end 16 of the return manifold 15 is a riser tube 35. Operably coupled to the riser tube 35 is the breathing assembly 40 and the mouthpiece 45.

Still referring to FIG. 1, the air intake 5 is generally cylindrical in shape having a first end 4 and second end 3 and is manufactured from a suitable durable material such as but not limited to plastic. The air intake 5 functions to provide a means for air to be introduced into the air warming apparatus 100. Intermediate the first end 4 and second end 3 is an air filter 7. The air filter 7 is operable to reduce the contaminant concentration in the air being introduced into the air warming apparatus 100. It is contemplated within the scope of the present invention that the air filter 7 could be manufactured from numerous different material such as but not limited to a HEPA filter material. This type of material would not only substantially remove airborne contaminants but additionally allergens. The first end 4 of the air intake 5 is configured to be removable to facilitate the changing of the air filter 7. Those skilled in the art will recognize that the first end 4 could be releasably secured using numerous suitable techniques. While the air intake 5 has been disclosed herein as being generally cylindrical in shape, it is contemplated within the scope of the present invention that the air intake 5 could be formed in numerous different shapes and still achieve the desired function as described herein. While not particularly illustrated herein, it is contemplated within the scope of the present invention that the air intake 5 will further include a retaining mechanism such as but not limited to a clip that will allow a user to releasably secure the air intake 5 to an article of clothing or a belt. Sealably coupled to the second end 3 of the air intake 5 is the intake tube 10. The intake tube 10 includes a first end 11 and second end 12 and operably couples the air intake 5 to the intake manifold 15. The intake tube 10 is operable to transport air from the air intake 5 to the lower portion 14 of the intake manifold 15. The intake tube 10 is manufactured from a suitable durable and flexible material such as but not limited to medical grade silicon or rubber.

Figure 3:
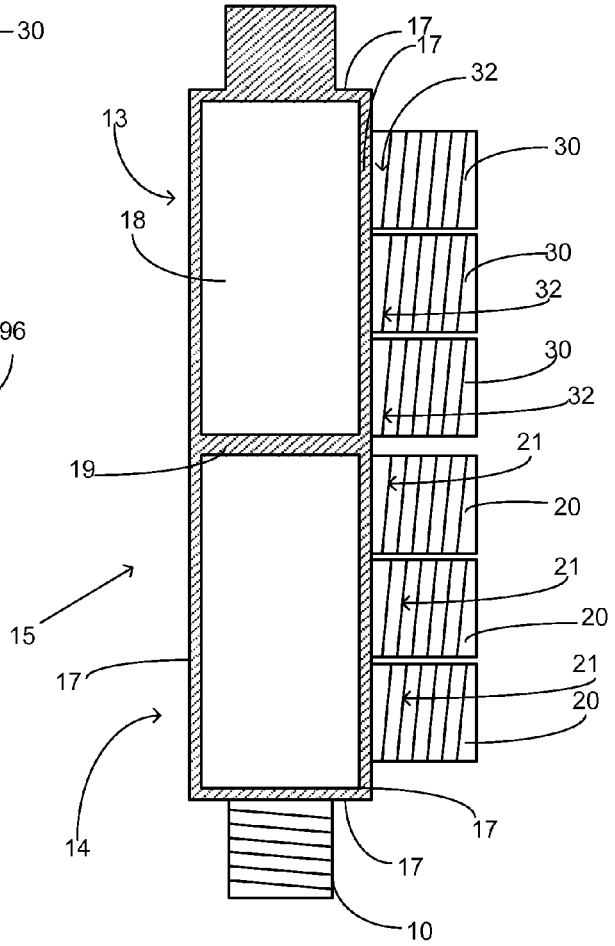
FIG. 3 is a cross-sectional view of the intake manifold of the present invention.
Figure 4:
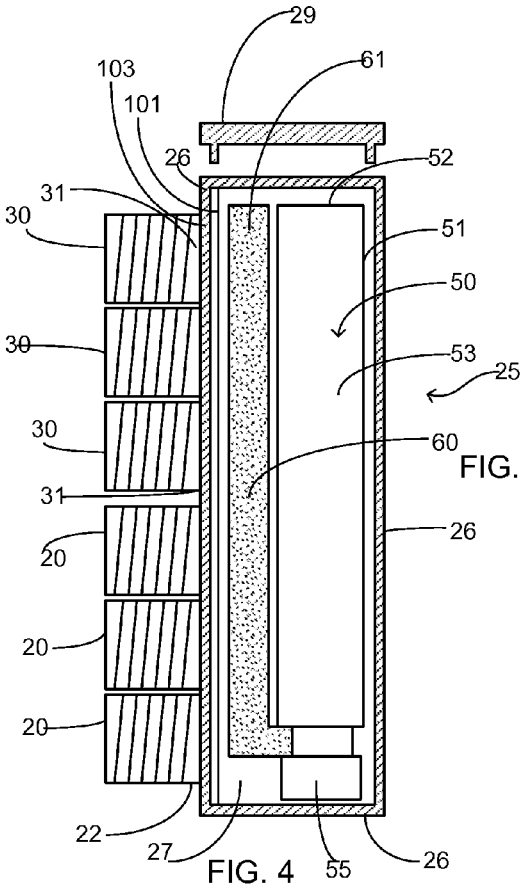
FIG. 4 is a cross-sectional view of the return manifold of the present invention.

As shown in FIGS. 1 and 3 the intake tube 10 is sealably secured to the lower portion 14 of the intake manifold 15. The intake manifold 15 is generally rectangular in shape being manufactured from a suitable durable rigid material such as but not limited to plastic. The intake manifold 15 includes a plurality of walls 17 integrally formed to create an interior volume 18. A dividing partition 19 is present within the interior volume 18 and is operable to separate the intake manifold 15 into a lower portion 14 and an upper portion 13. The lower portion 14 and the upper portion 13 of the intake manifold are operably isolated such that air present in either the lower portion 14 or upper portion 13 is isolated from each of the opposing portions. Air flows into the lower portion 14 of the intake manifold 15 from the intake tube 10 and exits the lower portion 14 via the lower air transport members 20. The lower air transport members 20 are operably and sealably coupled with the intake manifold 15. The lower air transport members 20 are manufactured from a suitable durable and flexible material such as but not limited to medical grade silicon or rubber tubing. While no particular diameter of tubing is required, good results have been achieved utilizing a tubing that is approximately one inch in diameter for the lower air transport members 20. The lower air transport members 20 have a first ends 21 and a second ends 22. The first ends 21 are sealably secured to the intake manifold 15 using suitable techniques. The lower air transport members 20 are operable to provide the first stage warming of the air that is passing therethrough. The air warming apparatus is operable to be surroundably mounted to a user's torso. The lower air transport members 20 are adjacent a user's abdomen subsequent the air warming apparatus 100 being secured to a user. The temperature of the user's torso operable to warm the air present in the lower air transport members 20 via conduction. As air is introduced into the lower air transport members 20 the air flows in a direction from the first end 21 towards the second end 22. As the air flows within the lower air transport members 20 any air present that is lower than that of the average human body temperature will be warmed as it passes through the lower air transport members 20. The lower air transport members 20 provide the first phase of increasing the temperature of the air flowing through the air warming apparatus 100. The air warming apparatus 100 includes three lower air transport members 20 as this quantity has shown to be desirable in delivering the appropriate volume of air through the air warming apparatus 100 while in use. While three lower air transport members 20 are disclosed herein in the preferred embodiment, it is contemplated within the scope of the present invention that the air warming apparatus 100 could have more or less than three lower air transport members 20.

As the air flows through the lower air transport members 20 and is simultaneously warmed by the body heat of the user of the air warming apparatus 100, the air will exit the lower air transport members 20 proximate ends 22 and is deposited into the return manifold 25. The return manifold 25 is generally rectangular in shape having a plurality of integrally formed walls 26 creating an interior volume 27. The interior volume 27 is a single space and is operable to receive and store therein the humidifier 50. The return manifold 25 functions to receive air therein and increase the relative humidity thereof prior to the air flow passing into the upper air transport members 30. The return manifold 25 is adjacent to the intake manifold 15 when the air warming apparatus 100 is being worn by a user. The return manifold 25 and the intake manifold 15 are configured to be releasably secured to each other utilizing suitable techniques such as but not limited to mechanical fasteners. The humidifier 50 includes a wall 51 that is generally cylindrical in shape and a bottom 52 integrally formed therewith to create an interior volume 53. A cap 55 is releasably secured to the humidifier 50 opposite the bottom 52. Operably secured by cap 55 is wick 60. The wick 60 is manufactured from an absorbent material and is operable to draw the fluid disposed within the interior volume 53 into the wick 60 via capillary action. The wick 60 is saturated with the fluid, preferably water, and is operable to increase the relative humidity of the air passing through the return manifold as it transitions between the lower air transport members 20 and the upper air transport members 30. While no particular relative humidity is required for the air exiting the return manifold 25, it is contemplated within the scope of the present invention that the humidifier 50 is operable to change the relative humidity of the air exiting the return manifold to a relative humidity level within the range of thirty-five to fifty percent relative humidity. This range of relative humidity provides a more comfortable breathing experience for the user of the air warming apparatus 100. The humidifier 50 is placed within the interior volume 27 of the return manifold 25 in an inverted position. The inverted position is critical as it reduces the probability that moisture will egress from the end 61 of the wick 60 and collect within the interior volume 27 of the return manifold 25. The return manifold 25 includes a removable portion 29 configured to provide access to the interior volume 27 so as to facilitate the removal of the humidifier 50 and replacement thereof as the humidifier 50 routinely requires the addition of fluid. A screen 101 is intermediate the wick 60 and wall 103. The screen 101 function to inhibit the wick 60 from blocking the openings of the upper air transport members 30 and the lower air transport members 20 so as to avoid disrupting the air flow. The screen 101 is manufactured from a suitable durable material and is constructed similar to conventional screens having a plurality of apertures to ensure proper airflow therethrough.

As the air exits the return manifold 25 and flows into the upper air transport members 30 the air disposed within the upper air transport members 30 undergoes the second phase of warming provided by the air warming apparatus 100. As the air flows through the upper air transport members 30 from the first ends 31 to the second ends 32 the temperature thereof is further increased as the body heat of the user. This second phase of heating is operable to provide a much warmer air temperature delivered to the user. More specifically but not by way of limitation, utilizing the configuration of the present invention air entering the air intake 5 that is approximately six degrees Fahrenheit will be warmed to approximately eighty-eight degrees Fahrenheit when delivered at the mouthpiece 45. An exemplary table of air temperature increases provided by the air warming apparatus 100 has been included herein. The upper air transport members 30 are manufactured from a similar material as the lower air transport members 20 and are tubular in shape having a passage therethrough. The air flowing through the upper air transport members 30 is deposited into the upper portion 18 of the intake manifold 15.

The air continues to flow from the upper portion 18 of the intake manifold 15 into the riser tube 35. The riser tube 35 includes a first end 36 and a second end 37. The riser tube 35 is operably and sealably coupled to the upper portion 18 of the intake manifold 15. The riser tube 35 is manufactured from a suitable durable material such as but not limited to medical grade silicon and is substantially hollow having a passage therethrough. The riser tube 35 is operable to transport the air flowing through the air warming apparatus 100 from the intake manifold 15 to the breathing assembly 40. While no particular length of the riser tube is required, it is contemplated within the scope of the present invention that the length of the riser tube is at least the length of the user's torso so as to assist in the proper positioning of the mouthpiece 40. While not particularly illustrated herein it is contemplated within the scope of the present invention that the riser tube 35 is substantially covered with an insulative material so as to minimize the heat loss of the air flowing therethrough. Those skilled in the art will recognize that numerous types of insulative material could be utilized to cover the riser tube 35.

Figure 5:
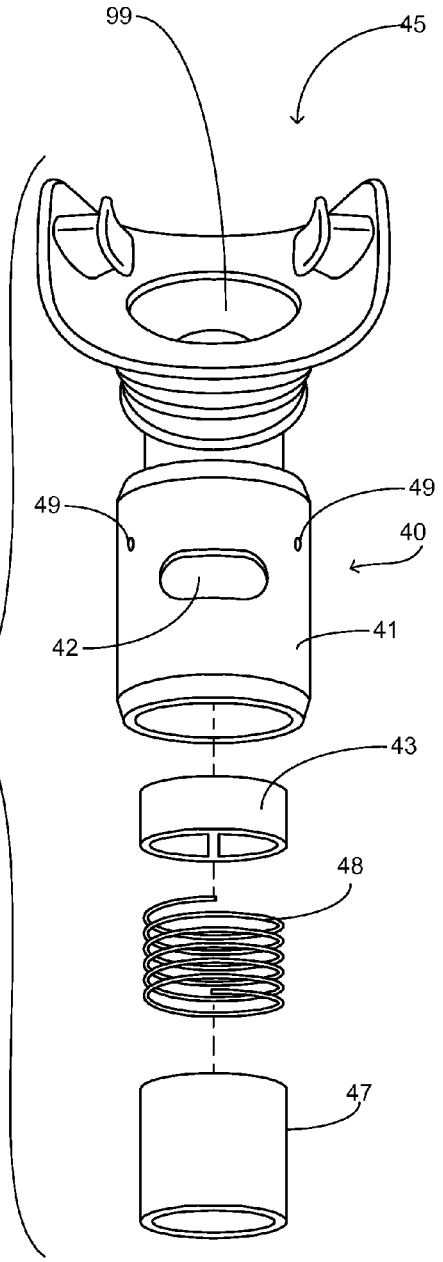
FIG. 5 is a detailed view of the mouthpiece and breathing valve of the present invention.
Figure 6A:
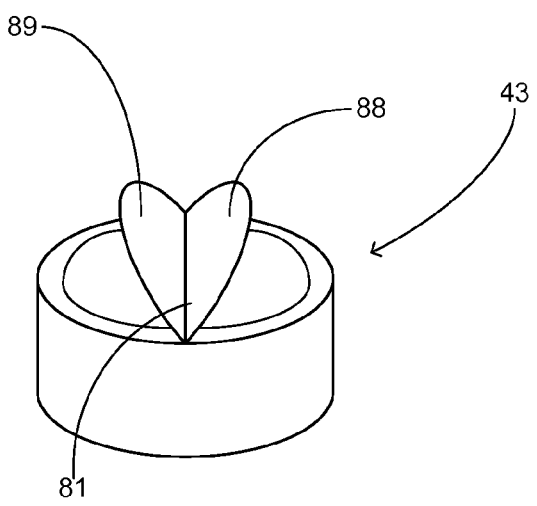
FIG. 6A is a side diagrammatic view of the piston of the breathing valve of the present invention with the butterfly valve in an open position.
Figure 6B:
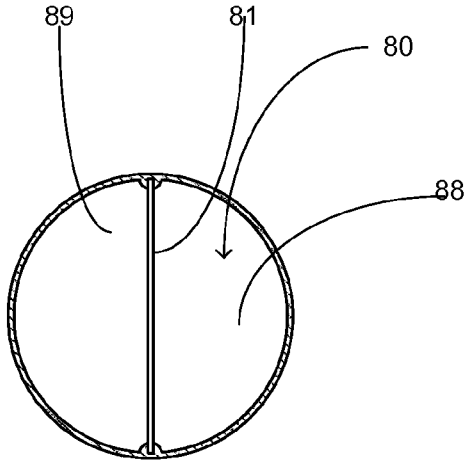
FIG. 6B is a top view of the piston of the breathing valve of the present invention with the butterfly valves in the closed position.

Referring in particular to FIG. 5, the breathing assembly 40 is illustrated therein in an exploded view. The breathing assembly 40 includes a housing 41 that is generally cylindrical in shape and manufactured from a suitable durable material such as but not limited to plastic. The housing 41 further includes an exhalation port 42. The exhalation port 42 is an aperture generally oval in shape that functions to allow the air exhaled from the user to egress the housing 41 therefrom. This keeps the exhalation air from a user from reentering the riser tube 35 and promotes the proper flow path of the air through the air warming apparatus 100. While only one exhalation port 42 is shown it is contemplated within the scope of the present invention that three exhalation ports 42 are present located circumferentially around the housing 41 wherein the center of each exhalation port 42 is approximately one hundred and twenty degrees apart from the adjacent exhalation port 42. This configuration promotes complete evacuation of the exhalation air of the user from the housing 41. While the exhalation port 42 is illustrated herein as being generally oval in shape, it is contemplated within the scope of the present invention that the exhalation port 42 could be formed in numerous different shapes. Movably mounted within the housing 41 is the piston 43. The piston 43 is generally annular in shape and is manufactured from a suitable durable material such as but not limited to plastic. The piston 43 as shown in particular in FIG. 6*a*, has a first aperture 44 and a second aperture 46 that are of approximately equal size and generally crescent-shaped. FIG. 6*a* illustrates the piston 43 with the butterfly valve 80 in an open position so as to allow air to flow through the piston 43. In this position the user has inhaled causing the butterfly valve 80 to move to its open position so as to allow air to flow towards the mouthpiece 45. In its open position the butterfly valve 80 hinges along it center seam 81. The center seam 81 is constructed of a rigid material such as but not limited to metal. Illustrated in FIG. 6*b*, the butterfly valve 80 is manufactured of a thin flexible material such as but not limited to silicon. The butterfly valve 80 consists of two generally equal halves 88, 89 and is superposed the top of the piston 43 being secured in place with the center seam 81. The flexibility of the butterfly valve 80 is such that the butterfly valve 80 will open during inhalation of the user and then moves to a closed position during exhalation of the user so as to substantially block the first aperture 44 and second aperture 46. The air pressure on the butterfly valve 80 during the exhalation of the user develops sufficient pressure to move the piston 43 in a downward position so as to allow the exhalation air to escape the exhalation ports 42. The butterfly valve 80 is generally annular in shape and is of similar diameter as the piston 43. In its first position the piston 43 blocks the exhalation ports and is biased against the stops 49. The stops 49 are manufactured from a suitable durable material and function to inhibit the upward travel of the piston 43 therepast. In this position, warmed air from the riser tube 35 is delivered to the user during inhalation. As the user exhales, the butterfly valve 80 closes and the air pressure exerted thereon during the exhalation process moves the piston 43 to its second position. In its second position the piston 43 has moved away from the mouthpiece 45 so as to be positioned beneath the exhalation ports 42. This allows the exhaled air of the user to escape the exhalation ports 42. The piston 43 is movably mounted on the spring 48. The spring 48 is a conventional spring that biases against the piston 43 so as to place the piston 43 against the stops 49 when the spring is at least partially extended. The retaining ring 47 functions to provide a fixed element for the spring 48 to bias thereagainst in order to provide the movement of the piston 43 as described herein.

The mouthpiece 45 is a conventional mouthpiece having an opening 99 operable to allow air to flow to the user. It is desirable within the scope of the present invention that a mouthpiece is the desired interface for the user. Utilizing a mouthpiece 45 as the present invention provides several advantages. More specifically but not by way of limitation, utilization of a mask would create fogging of glasses or similar articles and user's naturally breath through their mouth during heavy exercise.

Figure 2:
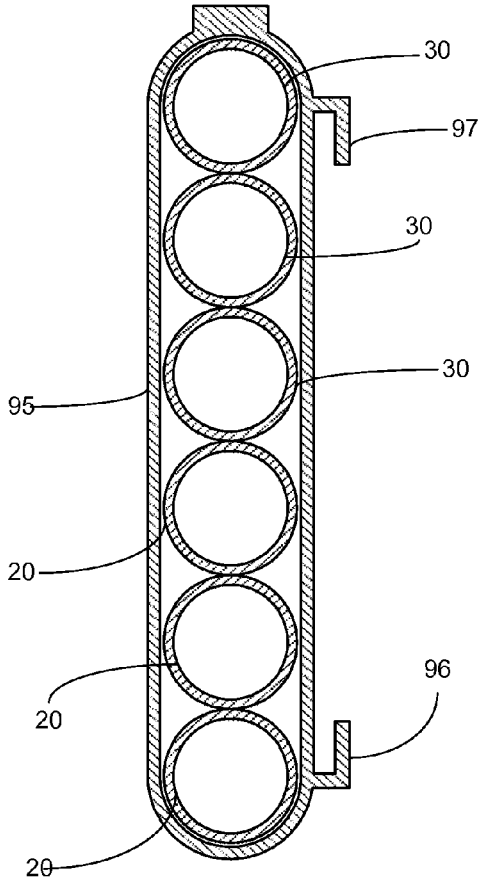
FIG. 2 is a cross-sectional view of the tubing assembly of the present invention.

Referring in particular to FIG. 2, a cross-section of the upper air transport members 30 and lower air transport members 20 are illustrated therein. The upper air transport members 30 and lower air transport members 20 are mounted in a stacked configuration and retained in this configuration by a plurality of retaining rings 95. The stacked configuration allows each of the lower air transport member 20 and upper air transport member 30 to be positioned close to the torso of the user so as to promote the maximum amount of heating. The retaining rings 95 surroundably mount the upper air transport members 30 and lower air transport members 20. The retaining rings 95 are manufactured from a suitable durable material such as but not limited to plastic. The retaining ring 95 further include an upper bracket 97 and lower bracket 96 that are integrally formed with the retaining ring 95. The upper bracket 97 and lower bracket 96 are operable to engage an item such as but not limited to a belt so as to assist in securing the air transport assembly 110 to the torso of a user. It is contemplated within the scope of the present invention that the air transport assembly 110 could have mounted thereto numerous different quantities of retaining rings 95.

A description of the general operation and flow path during use is as follows. In use, subsequent the user mounting the air warming apparatus 100 to their torso, a user will inhale through the mouthpiece 45 moving the butterfly valve 80 to its open position. During inhalation, air is drawn into the air intake 5 and flows through the intake tube 10 into the intake manifold 15. The air will then exit the intake manifold 15 and enter all three lower air transport members 20 and travel therethrough. This is the first warming phase of the inhaled air. The air will exit the three lower air transport members 20 and be deposited into the return manifold 25. While the air is disposed within the return manifold 25 the relative humidity of the air is increased from the humidifier 50. Next, the air will then enter all three of the upper air transport members 30 and travel therethrough wherein the second phase of air warming occurs. As the air exits the upper air transport members 30, it is deposited into the upper portion 13 of the intake manifold 15. Subsequently the air will flow into the riser tube 35, through the breathing assembly 40 and lastly the mouthpiece 45 to be delivered to the user. During exhalation the piston 43 is moved as previously discussed herein such that the exhalation ports 42 are substantially unrestricted so as to allow the exhaled air to egress therefrom.

While the air transport assembly 110 has been disclosed herein as having three upper air transport members 30 and three lower air transport members 20 it is contemplated within the scope of the present invention that the air transport assembly 110 could have as few as one upper air transport assembly 30 and lower air transport assembly 20.

An exemplary table, Table 1, provides a matrix of the temperature of air delivered to the user wherein the table lists the environmental air temperature and the air temperature at the mouthpiece 45 when delivered to the user. The first phase and second phase of the air transport assembly is required to achieve the exemplary temperatures listed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

TABLE 1

| External Air Temperature | Air Temperature at Mouth Piece | Relative Humidity at Mouth Piece |
|---|---|---|
| 6 degrees Fahrenheit | 88 degrees Fahrenheit | 39% |
| 14 degrees Fahrenheit | 88 degrees Fahrenheit | 40% |
| 20 degrees Fahrenheit | 89 degrees Fahrenheit | 41% |
| 30 degrees Fahrenheit | 90 degrees Fahrenheit | 43% |

What is claimed is:

1. An air warming system operable to increase the temperature of air exiting therefrom wherein the air exiting the air warming system is at a temperature greater than that of air entering the air warming system comprising:

an air intake, said air intake further including an outlet said outlet having a tube operably coupled thereto, said air intake operable to receive air into the air warming system;

an air transport assembly, said air transport assembly further including a first manifold and a second manifold, said first manifold having an upper portion and a lower portion, said upper portion and said lower portion separated by a dividing wall, said air transport assembly further including a plurality of tubing, said plurality of tubing being arranged in a vertical stacked manner, said plurality of tubing operably coupled to said first manifold and said second manifold, said air transport assembly being surroundably mounted to a user's torso wherein said plurality of tubing is adjacent thereto, said air transport assembly configured so as to facilitate the air disposed therein to circumferentially flow around the torso of a user a first occurrence and a second occurrence within said plurality of tubing; and a breathing assembly, said breathing assembly being operably coupled to said air transport assembly, said breathing assembly providing an interface for the user to engage the air warming system and breathe therefrom.

2. The air warming system as recited in claim 1, wherein said second manifold further includes a humidifier, said humidifier operable to increase the relative humidity of the air flowing through said second manifold.

3. The air warming system as recited in claim 2, wherein said breathing assembly further includes a housing, said housing being hollow and having a piston disposed therein, said piston having a first position and a second position, said piston operable to facilitate the exhalation of air from the air warming system in said second position.

4. The air warming system as recited in claim 3, and further including a butterfly valve, said butterfly valve being superposedly mounted to said piston, said butterfly valve having a first position and a second position, in said first position said butterfly valve operable to allow air to flow through said piston.

5. The air warming system as recited in claim 4, wherein said housing further includes a plurality of exhalation ports, said exhalation ports operable to allow air to egress said housing when said piston is in said second position.

6. The air warming system as recited in claim 5, and wherein the air warming system is operable to increase the air temperature by at least sixty degrees when utilized in an environment having a temperature between six degrees Fahrenheit and thirty degrees Fahrenheit.

7. An air warming system configured to be worn by a user wherein the user is in an external environment and wherein the air warming system is operable to supply air at a temperature that is warmer than that of the user's external environment comprising:

an air intake, said air intake being generally cylindrical in shape, said air intake further including an air filter, said air intake being releasably secured to the user, said air intake having an outlet tube operably coupled thereto, an air transport assembly, said air transport assembly further including a first manifold and a second manifold, said first manifold operably coupled to said outlet tube, said air transport assembly having a plurality of tubing, said plurality of tubing being circumferentially mounted to the user's torso, said plurality of tubing being arranged in a vertically stacked manner, said plurality of tubing operably divided into a first section and a second section, wherein the first section and the second section are configured to facilitate the passage of air completely around the user a first time and a second time so as to increase the air temperature of the air within said air transport assembly; said first manifold and said second manifold being mounted adjacent to each other, said first manifold having an upper chamber and a lower chamber, said upper chamber and said lower chamber being atmospherically isolated with a dividing wall, said air transport assembly being operably coupled to a riser tube, said riser tube operable to direct the flow of air egressing from said air transport assembly; and a breathing assembly, said breathing assembly operable to provide an interface for the user to breathe air from the air warming system, said breathing assembly operably coupled with said riser tube distal from said air transport assembly, said breathing assembly further including a housing generally cylindrical in shape being substantially hollow, said housing having a first end and a second end, said breathing assembly further including a mouthpiece.

8. The air warming system as recited in claim 7, and further including a humidifier, said humidifier being disposed within said second manifold, said humidifier being generally cylindrical in shape having a wall and a bottom integrally formed so as to form an interior volume and an opening, said humidifier further including a wick.

9. The air warming system as recited in claim 8, wherein said housing of said breathing assembly further includes a plurality of exhalation ports, said exhalation ports operable to facilitate the expelling of exhaled air from the user into the atmosphere.

10. The air warming system as recited in claim 9, wherein said housing of said breathing assembly further includes a piston, said piston having at least one passage therethrough for air flow, said piston having a first position and a second position, wherein in said first position said piston is operable to substantially cover said exhalation ports.

11. The air warming system as recited in claim 10, and further including a butterfly valve, said butterfly valve operably coupled said piston and superposed thereon, said butterfly valve having a first position and a second position, wherein in said second position said butterfly valve operable to allow air to flow through the at least one passage of said piston.

12. The air warming system as recited in claim 11, and wherein the air warming system is operable to increase the air temperature by at least sixty degrees when utilized in an environment having a temperature between six degrees Fahrenheit and thirty degrees Fahrenheit.

13. An air warming device configured to be worn by a user wherein the air warming device is operable to provide air to the user that is warmer than that of the external surroundings of the user comprising:

an air intake, said air intake being operable to facilitate the introduction of air into the air warming system, said air intake being generally cylindrical in shape, said air intake further including a filter, said air intake further including at least one fastener operable to releasably secure said air intake to the user, said air intake further including an outlet tube operable to permit air to flow outward of said air intake and be contained within said outlet tube;

an intake manifold, said intake manifold being generally rectangular in shape, said intake manifold having a lower chamber and an upper chamber, said lower chamber and said upper chamber being atmospherically isolated by a dividing wall, said dividing wall being impermeable, said intake manifold operably coupled to said outlet tube, said intake manifold operable to receive air from said air intake, wherein the air received from said air intake is received in said lower chamber of said intake manifold;

a lower air transport assembly, said lower air transport assembly consisting of three tubes, said three tubes being arranged in a vertically stacked pattern, said lower air transport assembly having a first end and a second end, said first end of said lower transport assembly being operably coupled to said lower chamber of said intake manifold, said lower air transport assembly being surroundably mounted the user, wherein the air flowing through said lower air transport assembly is heated as the air travels therethrough, a return manifold, said return manifold being rectangular in shape having an interior volume, said return manifold being mounted adjacent said intake manifold, said return manifold operably coupled to said second end of said lower air transport assembly, said return manifold having a humidifier disposed therein;

an upper air transport assembly, said upper air transport assembly consisting of three tubes, said three tubes configured in a vertically stacked arrangement, said three tubes configured to allow air to flow therethrough, said upper air transport having a first end and a second end, said first end of said upper air transport being operably coupled with said return manifold, said upper air transport configured to have air pass therethrough wherein the upper air transport is circumferentially surrounding the user's torso so as to provide heat to air flowing through said upper air transport in order to increase the temperature thereof, wherein said second end of said upper air transport assembly is operably coupled to said upper chamber of said intake manifold;

a riser tube, said riser tuber having a first end and a second end, said first end of said riser tube being operably coupled to said upper chamber of said intake manifold, said riser tube operable to allow air to flow outward from said upper chamber of said intake manifold;

a breathing assembly, said breathing assembly operable to facilitate the user breathing air from the air warming device, said breathing assembly further including a housing and a mouthpiece; and wherein the air warming device is operable to heat the air passing therethrough a first time as air flows through said lower air transport assembly and a second time as air flows through said upper air transport assembly, via conduction of body heat from the user wearing the air warming device.

14. The air warming device as recited in claim 13, wherein the housing of said breathing assembly is generally cylindrical in shape having a passage therethrough, said housing having three exhalation ports, said exhalation ports operable to discharge air.

15. The air warming device as recited in claim 14, wherein said humidifier is generally cylindrical in shape having a wall and a bottom forming an interior volume, said humidifier having an opening, said opening having a releasably secured cap thereon, said humidifier further including a wick, said wick being partially disposed within said interior volume of said humidifier and partially disposed externally thereto, said humidifier being oriented in an inverted position within said return manifold.

16. The air warming device as recited in claim 15, and further including a piston, said piston having a first passage and a second passage, said first passage and said second passage being crescent shaped, said piston having a first position and a second position, in said first position said piston being operable to cover said exhalation ports of said housing so as to allow air from said riser tube to flow to said mouthpiece, wherein in said second position said piston being removed from said exhalation ports so as to allow exhalation air from the user egress from said exhalation ports.

17. The air warming device as recited in claim 16, and further including a butterfly valve, said butterfly valve operably coupled said piston and superposed thereon, said butterfly valve having a first position and a second position, wherein in said second position said butterfly valve operable to allow air to flow through said piston, and wherein in said second position said butterfly valve operable to cover the first passage and said second passage of said piston so as to transition said piston to said second position as a result of force exerted thereon by exhalation air from the user.

18. The air warming device as recited in claim 17, and further including a plurality of retaining clips, said retaining clips surroundably mounted said upper air transport assembly and said lower air transport assembly, said retaining clips operable to maintain said three tubes of said upper air transport assembly and said three tubes of said lower air transport assembly in a vertically stacked position.

* * * * *